United States Patent [19]

Yuhash et al.

[11] 4,301,737

[45] Nov. 24, 1981

[54] MULTI-PURPOSE KINETIC ENERGY PROJECTILE

[75] Inventors: Ladd Yuhash, Budd Lake; Charles E. Lanizzani, Dover, both of N.J.

[73] Assignee: The United States of America as represented by the Secretary of the Army, Washington, D.C.

[21] Appl. No.: 81,971

[22] Filed: Oct. 4, 1979

[51] Int. Cl.[3] ..... F42B 11/06

[52] U.S. Cl. ..... 102/518; 102/493

[58] Field of Search ..... 102/52, 67, 68, 92.1, 102/92.3, 92.4, 93, 491, 493, 517, 518, 519, 520, 522

[56] References Cited

U.S. PATENT DOCUMENTS

| | | | |
|---|---|---|---|
| 927,852 | 7/1909 | Grunwald | 102/52 |
| 1,094,395 | 4/1914 | Van Kampen et al. | 102/52 X |
| 1,297,873 | 3/1919 | Laurie | 102/67 X |
| 1,305,967 | 6/1919 | Hawks | 102/67 X |
| 1,892,152 | 12/1932 | Jones | 102/91 |
| 2,811,901 | 11/1957 | Barr | 89/14 SB |
| 3,677,183 | 7/1972 | Talley | 102/67 |
| 3,714,900 | 2/1973 | Feldmann | 102/52 |
| 4,015,528 | 4/1977 | Barr | 102/52 |

*Primary Examiner*—Harold J. Tudor

*Attorney, Agent, or Firm*—Nathan Edelberg; Robert P. Gibson; Harold H. Card, Jr.

[57] ABSTRACT

A dual purpose armor piercing and antipersonnel round for battlefield use has a penetrator core surrounded by multiple wedge-shaped blades which disperse radially outward upon impact of the round against a target. The penetrator maintains a uniform path of travel to punch through armor, while the multiple blades tumble at high speed laterally to defeat massed troops around the area of impact.

10 Claims, 2 Drawing Figures

MULTI-PURPOSE KINETIC ENERGY PROJECTILE

GOVERNMENTAL INTEREST

The invention described herein may be manufactured, used and licensed by or for the Government for Governmental purposes without payment to me of any royalty thereon.

BACKGROUND OF THE INVENTION

Vehicles for battlefield use by infantry typically include armored personnel carriers manned by several combat soldiers. These vehicles carry protective armor plating to allow the occupants to traverse areas under moderate enemy fire with a minimum of battle casualties. The vehicles normally are equipped with small caliber weapons such as 20 millimeter automatic canon and one or more 30 caliber or 50 caliber machine guns. Such canons are useful mainly against enemy vehicles of the same type mentioned, but at a limited range such as 500 meters insofar as armor piercing capability using conventional 20 mm AP projectiles. Machine guns such as mentioned are useful mainly for deterrent effect over relatively medium range limited areas of terrain and are ineffective either against point targets or multiple targets dispersed at wide angles.

Both of the foregoing limitations of existing small arms weapons render them unsuitable for massed troop attacks such as encountered in the Korea and Vietnam conflicts. This tactic operates simply to present more moving targets at one time and place than either long or short range guns firing conventional ammunition can address individually or collectively. This problem is further compounded when such massed multiple targets further include multiple levels of vulnerability as for example flesh targets and protective armor plate, at close range as well as relatively distant range during closure of battle forces in a typical direct encounter.

The 20 mm high explosive round does not become armed until after it traverses 40 to 50 meters from the muzzle, hence provides no defense against massed personnel attacks within a range of 50 meters. The 20 mm armor piercing round is not effective against such attacks at any range, because it is point target limited and can address only a few points with each burst. In addition, it is not performance reliable beyond 500 meters against armored targets.

SUMMARY OF THE INVENTION

The invention is a projectile of intermediate size such as 30 mm having a dual performance capability including both armor piercing for point target effectiveness and multi-directional tumbling shrapnel characteristics against area wide antipersonnel targets. The projectile consists essentially of a central high-density core penetrator, a plurality of radially disposed blades surrounding the core, and a plastic sheath or housing for containment of these items until their use against battlefield targets.

DETAILED DESCRIPTION OF THE PREFERRED EMBODIMENT

Figure 2:
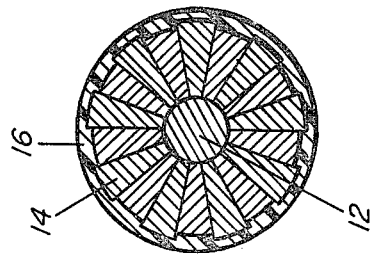
FIG. 2 is a transverse cross-sectional view taken along line 2—2 in FIG. 1.
Figure 1:
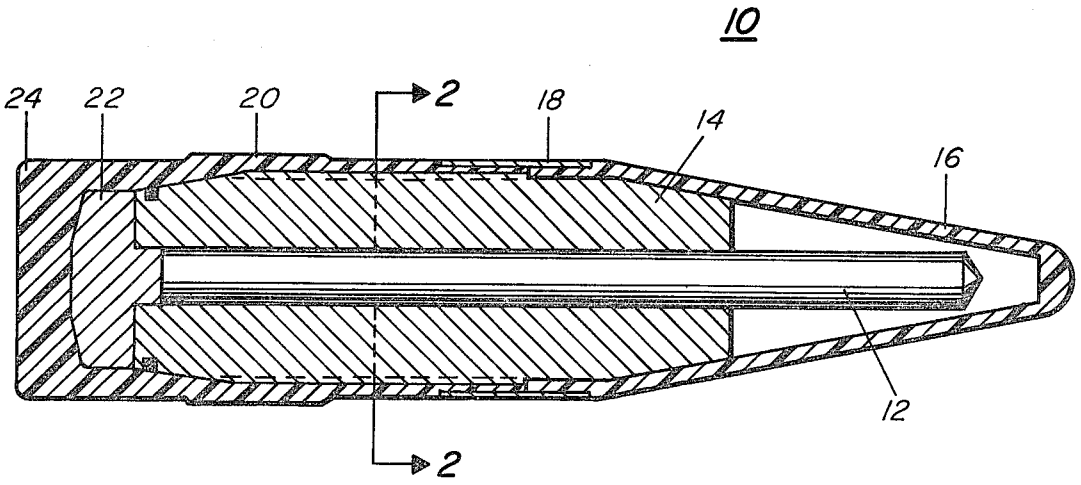
FIG. 1 is side elevational view, partly in cross section, of the novel projectile in this case.

Referring to FIG. 1, the novel structure comprises an elongate projectile generally designated by the reference numeral 10 and has a center elongate penetrator core 12 disposed concentrically about the longitudinal axis of symmetry of the projectile, as seen also from FIG. 2. Projectile 10 further includes a plurality of substantially flat elongate blades 14 generally parallel to core 12 and radially disposed about the core 12 in an alternating star pattern best seen from FIG. 2. Although substantially flat, the blades 14 are slightly wedged-shaped in lateral cross section transverse to their long axis, having a relatively narrow thickness along one side edge of their total length and a relatively wider thickness along the oppositely corresponding spaced-apart and generally parallel side edge. The thicker edge is situated at the greater radial distance form core 12 when the blades 14 are assembled in operative relationship within the projectile as seen in FIG. 2, while the thinner edge of each blade is closely proximate or actually contacts the cylindrical core surface along most of its length as seen in FIG. 1. Also, half the blades 14 vary in dimension with regard to the distance intermediate their thick and thin edges with respect to the other half of such blades as seen in FIG. 2 wherein every other blade is dimensioned uniformly or substantially identical, and the alternate blades 14 have a shorter expanse between their thicker and thinner edges. This results in alternate blades having greater mass than those of lesser mass which interlie between them, and these larger blades project radially outwardly a greater distance from core 12 than the blades of lesser mass. Thus, the thicker edge of each larger blade protrudes beyond the thicker edge of each smaller blade.

Projectile 10 has an outer covering of any suitable substantially rigid material which may be metallic or nonmetallic and in the preferred embodiment is plastic. In any case, the outer covering may consist of separate component sections, such as nose fairing or windshield cone portion 16 seen in FIG. 1, and aft or tail section portion or casing 24 which overlies a steel pusher disc 22. Pusher disc 22 abuts the aft end of core 12 and blades 14 in firm force-transmitting relationship to move the projectile under the pressure of the propellant gas (not shown) when projectile 10 is fired from a gun. A surrounding substantially cylindrical rigid band 18 overlies the oppositely confronting annular distal edge portions of nosepiece 16 and aft covering section 24 where these edges abut under tightly clamping band 18 shown in FIG. 1. A relatively thick-walled section 20 integral with or otherwise formed on section 24 may optionally be provided as in FIG. 1 to function as an obturator and rotating band as in conventional ammunition. Section 20 is proximate the aft end of projectile 10.

The advantages of the dimensional relationship between blades 14 having alternately high or low mass and projecting two different lengths from core 12 as seen in FIG. 2 will now be addressed. It will be understood by those skilled in the art that external ballistic characteristics of projectile 10 require rapid rotation around its center longitudinal axis of symmetry, and that such rotation is achieved by rifling in the bore of the gun from which the round is fired. It will further be understood that this rotating force or torque is applied to projectile 10 primarily through rotating band 20 and is transmitted through the band to those portions of plastic sheath sections 16 and 24 which underlie band 18, and these plastic portions transmit rotational force to blades 14 and the remaining internal components of the projectile. Because the material in covering 16, 24 is relatively softer than the remaining projectile elements, slippage of the rotating sheath over the stationary inner elements might occur during the initial acceleration phase, especially when resistance to rotation is high due to inertia of the heavier inner projectile parts. The outward protrusion of alternate blades 14 into close nesting and force-transmitting relationship with the material of the sheath acts to key these operative elements positively together in firm, force-transmitting relationship such as to minimize or eliminate any chance of relative movement between blades 14 and covering elements 16 and 24.

OPERATION

In operation, two modes of use for projectile 10 will occur depending upon the type of target to be addressed. When hard targets such as armor plated vehicles or the like are presented along with soft targets, projectile 10 will be fired in the normal condition shown in the drawing. Upon impact against the armor, core 12 will penetrate therethrough while sheath 16, 24 will fragment through distortion, cutting and tearing under the failure stress environment of impact. The same random force pattern will hurl blades 14 laterally and radially outward, due to the simultaneous combination of centrifugal force from the spinning projectile and lineal compressive force from impact against a surface. This action will result in high velocity movement of blades 14 throughout the general area surrounding the point of impact such as to defeat personnel proximate such area.

Alternatively, when closely massed enemy troops are advancing and within short range of a position to be defended by use of projectile 10, an adjustable cutting device of the gun muzzle used to fire the projectile is contemplated. Use of such a device will cause cutting or scoring of sheath 16, 24 as the projectile exits the gun muzzle. This will so weaken the sheath that when the projectile is spinning and no longer under the surface constraints of the gun bore, the radial outward acceleration forces on blades 14 and core 12 will result in spontaneous fragmentation of the projectile immediately after leaving the bore. Random trajectories of blades 14 in all directions will produce a spraying pattern of dispersion adapted to cover a multitude of soft targets over a substantial area of terrain, thus increasing the effectiveness of close range gunfire against massed troop attacks.

It will be understood that the inventive concept is not limited to the exact details of construction shown and described, since obvious modifications will occur to persons skilled in the art.

We claim:

1. A dual purpose elongate gun-fired projectile comprising:

an elongate penetrator core axially aligned about the center longitudinal axis of said projectile, a plurality of substantially flat elongate blades disposed radially about said penetrator core and generally parallel to said core, and adapted to disperse radially outwardly by centrifugal force as said projectile exits from said gun, and a substantially rigid outer weakenable sheath over said core and said blades, said sheath being of a material relatively softer than said core and adapted to be weakened upon scoring of said sheath to permit said force to disperse said blades.

2. The structure of claim 1, further including:

a pusher disc in firm force-transmitting relationship abutting the aft end of said core and said blades.

3. The structure of claim 2, wherein:

said elongate blades have two spaced-apart substantially parallel side edges along their length, the first of said edges having a relatively narrow thickness and the other of said edges having a relatively wider thickness than said first edge to form a wedge-shape in lateral cross section transverse to the long axis of said blades.

4. The structure of claim 3, wherein:

said blades are disposed about said core with said first edge of each blade closely proximate said core and said other edge at a radial distance from said core.

5. The structure of claim 4, wherein:

half the total of said plurality of blades has lesser mass than the remaining larger half of said blades due to shorter distance intermediate said first side edge and said other side edge of each said blade of lesser mass.

6. The structure of claim 5, wherein:

said lesser mass blades interlie between said remaining larger blades in an alternating star pattern so that said larger blades project a greater radial distance from said core than said lesser mass blades.

7. The structure of claim 6 wherein:

said other edges of relatively wider thickness on said larger blades protrude radially beyond the said other edges of relatively wider thickness on said lesser mass blades, and a portion of said outer covering material is in close nesting and firm force-transmitting relationship with each of said other edges on said larger blades.

8. The structure of claim 7 above, wherein:

said outer covering material portion underlies a surrounding, substantially cylindrical, rigid rotating band in clamping relationship therewith.

9. The structure of claim 8 wherein:

said outer covering is plastic and includes a hollow nose cone firing portion.

10. The structure of claim 9, further including:

a relatively thick-walled section integrally formed on said outer covering proximate the aft end of a projectile to function as an obturator.

* * * * *